US007766460B2

(12) United States Patent
Sekiguchi

(10) Patent No.: US 7,766,460 B2
(45) Date of Patent: Aug. 3, 2010

(54) LIQUID-DROPLET JETTING APPARATUS

(75) Inventor: Yasuhiro Sekiguchi, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 916 days.

(21) Appl. No.: 11/606,688

(22) Filed: Nov. 30, 2006

(65) Prior Publication Data

US 2007/0120904 A1 May 31, 2007

(30) Foreign Application Priority Data

Nov. 30, 2005 (JP) ..... 2005-346679

(51) Int. Cl.
*B41J 2/045* (2006.01)
*B41J 2/05* (2006.01)

(52) U.S. Cl. ..... 347/68; 347/65

(58) Field of Classification Search ..... 347/65, 347/69–72; 400/124.14, 124.16; 310/311, 310/324

See application file for complete search history.

(56) References Cited

U.S. PATENT DOCUMENTS 7,293,860 B2 * 11/2007 Sekiguchi ..... 347/71
7,597,426 B2 * 10/2009 Ito ..... 347/68
7,607,760 B2 * 10/2009 Ito ..... 347/68

FOREIGN PATENT DOCUMENTS

JP 2003127354 5/2003

* cited by examiner

*Primary Examiner*—K. Feggins
(74) *Attorney, Agent, or Firm*—Eugene LeDonne; Joseph W. Treloar; Frommer Lawrence & Haug LLP

(57) ABSTRACT

In an ink-jet head as a liquid-droplet jetting apparatus, a manifold channel which supplies an ink to pressure chambers has a first area communicating with the pressure chambers and a second area communicating with a dummy nozzle formed therein, with the first and second areas sandwiching a projection therebetween. Air exists at an upper portion of the second area, and the air is in contact with the ink in the manifold channel. When a pressure is applied to the ink in the pressure chambers by a piezoelectric actuator so as to jet the ink from nozzles, a pressure wave is generated in the pressure chambers and is propagated to the manifold channel. The pressure wave propagated to the manifold channel is attenuated in the second area by the air which is in contact with the ink in the manifold channel.

10 Claims, 13 Drawing Sheets

LIQUID-DROPLET JETTING APPARATUS

CROSS-REFERENCE TO RELATED APPLICATION

The present application claims priority from Japanese Patent Application No. 2005-346679, filed on Nov. 30, 2005, the disclosure of which is incorporated herein by reference in its entirety.

BACKGROUND OF THE INVENTION

1. Field of the Invention

The present invention relates to a liquid-droplet jetting apparatus which jets a droplet of a liquid (liquid droplet) from a jetting port (discharge port).

2. Description of the Related Art

In an ink-jet head (liquid-droplet jetting apparatus) which jets an ink from nozzles by applying a pressure to the ink in pressure chambers, when the pressure is applied to the ink in a certain pressure chamber among the pressure chambers, a pressure wave is generated in the certain pressure chamber. When the pressure wave generated in the certain pressure chamber is propagated to another pressure chamber via a common liquid chamber which communicates with the pressure chambers, the jetting characteristics of the ink (ink-jetting characteristics) become non-uniform. Considering this situation, there has been hitherto known a technique for attenuating the pressure wave in the common liquid chamber to prevent the pressure wave generated in a certain pressure chamber from being propagated to another pressure chamber, thereby suppressing the ink-jetting characteristics from becoming non-uniform. For example, in an ink-jet recording head (ink-jet head) described in Japanese Patent Application Laid-open No. 2003-127354, a plurality of pressure generating chambers (pressure chambers) communicating with nozzles respectively communicate with an ink storage chamber (common liquid chamber) via an ink supply channel. A recess is formed in a head case at a portion thereof corresponding to the ink storage chamber, and a portion, of a vibration plate, which overlaps with the recess, functions as a damper which relieves a pressure fluctuation (attenuates the pressure wave) in the ink storage chamber.

However, in the ink-jet head described in Japanese Patent Application Laid-open No. 2003-127354, when an attempt is made to realize the densification and miniaturization of the ink-jet head, the common liquid chamber also becomes small in size. Therefore, it is not possible to form a recess having a sufficient size for attenuating the pressure wave, and thus the area dimension of the portion, of the vibration plate, which functions as the damper becomes small. Consequently, there is a fear that the pressure wave cannot be attenuated sufficiently in the common liquid chamber.

SUMMARY OF THE INVENTION

An object of the present invention is to provide a liquid-droplet jetting apparatus which is capable of efficiently attenuating the pressure wave in the common liquid chamber.

According to a first aspect of the present invention, there is provided a liquid-droplet jetting apparatus which jets liquid droplets of a liquid, the apparatus including a channel unit having a common liquid chamber which extends in a predetermined direction, a first individual liquid channel which is from a first connecting port to the common liquid chamber and up to a first jetting port via a pressure chamber, and a second individual liquid channel which is from a second connecting port to the common liquid chamber up to a second jetting port;

wherein the pressure chamber is formed as a plurality of pressure chambers arranged in a row along the common liquid chamber to form a pressure-chamber surface;

the common liquid chamber includes an upper wall surface which extends in the predetermined direction, a lower wall surface which is separated from the upper wall surface in a direction orthogonal to the pressure-chamber surface and which faces the upper wall surface, and a step-surface which extends from the upper wall surface so as to intersect the pressure-chamber surface;

the step-surface partitions the common liquid chamber into a first area with which the first individual liquid channel communicates, and a second area with which the second individual liquid channel communicates; and with respect to the direction orthogonal to the pressure-chamber surface, a distance between the pressure-chamber surface and a step-surface farthest portion, of the step-surface, which is disposed farthest from the pressure-chamber surface is greater than a distance between the second connecting port and the pressure-chamber surface; and an upper wall surface of the second area is separated from the second connecting port.

In this case, when the liquid-droplet jetting apparatus is constructed such that the pressure chambers are located above or higher than the common liquid chamber, then in the second area of the common liquid chamber, a gas such as air exists in a portion above or higher than the second connecting port (above or higher than an upper end of the second connecting port). Therefore, the liquid does not inflow into the portion above or higher than the second connecting port. In other words, the air comes in a direct contact with the liquid in the common liquid chamber. Consequently, the air acts or functions as a damper, thereby attenuating a pressure wave which is generated in the pressure chamber when a discharge energy (jetting energy) is imparted or applied to the liquid in a certain pressure chamber by an energy imparting mechanism, and which is propagated to the common liquid chamber. Accordingly, it is possible to suppress the occurrence of cross talk by preventing the pressure wave generated in the certain pressure chamber from propagating to the common liquid chamber then to another pressure chamber. Furthermore, by forming the step-surface in the common liquid chamber, it is possible to easily form the first area and the second area, and to ensure that the air does not flow from the second area to the first area. Here, the term "distance between the second connecting port and the pressure-chamber surface" means a distance between the pressure-chamber surface and a portion, of the portion defining the second connecting port, which is disposed closest to the pressure-chamber surface.

In the liquid-droplet jetting apparatus of the present invention, with respect to the direction orthogonal to the pressure-chamber surface, the distance between the pressure-chamber surface and the step-surface farthest portion may be greater than a distance between the pressure-chamber surface and a farthest portion, of a portion defining the second connecting port, which is disposed farthest from the pressure-chamber surface. In this case, the farthest step-surface portion, of the step-surface, which is disposed farthest from the pressure-chamber surface is formed at a position below or lower than the farthest portion, of the portion defining the second connecting port, which is disposed farthest from the pressure-chamber surface. Therefore, air existing in a portion, of the second area, above or higher than an upper end of the second connecting port, does not flow into the first area of the common liquid chamber. Accordingly, the jetting characteristics of the liquid droplet (liquid-droplet jetting characteristics) are prevented from being changed or varied at the first jetting port of the first individual liquid channel due to the air flowing into the first individual liquid channel.

In the liquid-droplet jetting apparatus of the present invention, with respect to the direction orthogonal to the pressure-chamber surface, a distance between the pressure-chamber surface and an upper wall surface of the first area, may be same as a distance between the pressure-chamber surface and the upper wall portion of the second area, In this case, it is possible to form the upper wall surface of the first area and the upper wall surface of the second area easily by a single plane.

In the liquid-droplet jetting apparatus of the present invention, with respect to the direction orthogonal to the pressure-chamber surface, a distance between the pressure-chamber surface and an upper wall surface of the first area, may be greater than a distance between the pressure-chamber surface and the upper wall surface of the second area. In this case, the upper wall surface of the second area is positioned above or higher than the upper wall surface of the first area. Accordingly, in the second area, a volume is increased at the portion thereof which is located above or higher than the upper end of the second connecting port, and in which the air exists. This improves the damper effect by the air, thereby making it possible to attenuate the pressure wave in the common liquid chamber more efficiently. Further, with respect to the direction orthogonal to the pressure-chamber surface, the distance between the pressure-chamber surface and the step-wall farthest portion may be same as the distance between the pressure-chamber surface and the upper wall surface of the first area. In this case, since a channel cross-sectional area is not decreased between the first area and the second area, the pressure wave is easily propagated from the first area to the second area. Consequently, it is possible to attenuate the pressure wave more efficiently by the air in the second area.

In the liquid-droplet jetting apparatus of the present invention, in the common liquid chamber, a liquid inflow port into which the liquid inflows and which is connected to the first area, the first area, the step-surface, and the second area may be formed in this order along the predetermined direction; and the second area may be connected to the first area via the step-surface. The liquid hardly flows to a portion, of the common ink chamber, disposed farthest from the liquid inflow port. Therefore, when the connecting port corresponding to the first individual liquid channel (the first connecting port), communicating with the first jetting port from which the liquid droplet is jetted, is formed in this portion of the common liquid chamber, an air bubble flows to the first individual liquid channel. In such a case, there is a fear that the jetting characteristics of the liquid droplet jetted from the jetting port are changed or varied. However, according to the above-described structure, the first connecting port is not formed in this portion. Rather, the second connecting port, communicating with the second jetting port which jets no liquid droplet, is formed in this portion of the common liquid chamber. Therefore, the liquid flows assuredly to the first individual liquid channel. Note that the air bubble which has in flowed into the common liquid chamber moves up to the portion, of the common liquid chamber, in which the air exists, and the air bubble acts as a damper together with the air existing in this portion.

In the liquid-droplet jetting apparatus according to the present invention, the common liquid chamber may include a plurality of common liquid sub-chambers formed in the channel unit; and the channel unit may further include a connecting channel which extends to connect at least two common liquid sub-chambers, among the plurality of common liquid sub-chambers, at the second area of each of the at least two common liquid sub-chambers. In this case, the common liquid sub-chambers are connected, at portions thereof in which the air exists, by the connecting channel. Accordingly, it is possible to attenuate the pressure wave in the common liquid sub-chambers more efficiently by the air in the common liquid sub-chambers.

In the liquid-droplet jetting apparatus of the present invention, a channel resistance in the second individual liquid channel may be smaller than a channel resistance in the first individual liquid channel. In this case, when the liquid is supplied to each of the first and second individual channels, the liquid easily inflows into the second individual liquid channel than into the first individual liquid channel, Therefore, it is possible to make the air remain in the second area assuredly.

In the liquid-droplet jetting apparatus of the present invention, the first area and the second area may have a same natural frequency. In this case, by making the natural frequency of the first area and the natural frequency of the second area to be same, the pressure in the common liquid chamber becomes uniform. Accordingly, it is possible to prevent the liquid-droplet jetting characteristics at the jetting port from being changed or varied due to the pressure wave reflected in the common liquid chamber.

The liquid-droplet jetting apparatus of the present invention may further include an energy imparting mechanism which imparts a jetting energy to the liquid in the pressure chambers;

wherein the energy imparting mechanism may include a piezoelectric layer facing the pressure chambers, and at least one pair of electrodes which applies an electric field to the piezoelectric layer. In this case, it is possible to construct the energy imparting mechanism with a simple structure including the piezoelectric layer facing the pressure chambers, and at least one pair of electrodes which applies electric field (jetting energy, discharge energy) to the piezoelectric layer.

According to a second aspect of the present invention, there is provided a liquid-droplet jetting apparatus which jets a liquid from a plurality of jetting ports, the apparatus including:

a plurality of pressure chambers which communicate with the jetting ports, respectively;

a common liquid chamber which communicates with the pressure chambers and which supplies the liquid to the pressure chambers; and an air damper chamber which is in fluid communication with the common liquid chamber and which retains a gas.

According to this structure, even when the liquid-droplet jetting apparatus is highly densified and miniaturized, the gas in the air damper chamber has a low stiffness (rigidity). Accordingly, it is possible to efficiently attenuate the pressure wave in the common liquid chamber as compared to a case in which the pressure wave is attenuated by a diaphragm type damper.

In the liquid-droplet jetting apparatus of the present invention, the liquid in the common liquid chamber and the gas may exist in the air damper chamber; and an interface between the gas and the liquid may function as a damper. In this case, even when the liquid-droplet jetting apparatus is highly densified and miniaturized, the gas in the air damper chamber has a low stiffness.

Accordingly, it is possible to efficiently attenuate the pressure wave propagated to the common liquid chamber.

In the liquid-droplet jetting apparatus of the present invention, the pressure chambers may be arranged in a row along the common liquid chamber to form a pressure-chamber surface;

the common liquid chamber may include an upper wall surface which extends along the pressure-chamber surface;

the air damper chamber may have an upper wall surface which extends along the pressure-chamber surface, and a connecting port which is connected to a dummy-jetting port which is different from the plurality of jetting ports; and the connecting port and the upper wall surface of the air damper chamber may be separated with respect to a direction orthogonal to the pressure-chamber surface. According to this structure, when the liquid-droplet jetting apparatus is constructed such that the pressure chambers are located above or higher than the common liquid chamber, then in the air damper chamber it is possible to retain or maintain the gas at a portion in the air damper chamber located above or higher than the connecting port. Further, since the gas is in contact with the liquid in the air damper chamber, a contact surface between the gas and the liquid functions as a damper which attenuates the pressure wave propagated to the common liquid chamber. Furthermore, the liquid-droplet jetting apparatus of the present invention may further include a partition wall which extends from the upper wall surface of the air damper chamber so as to intersect the pressure-chamber surface and which partitions the air damper chamber from the common liquid chamber;

wherein with respect to the direction orthogonal to the pressure-chamber surface, a distance between the pressure-chamber surface and a partition-wall farthest portion, of the partition wall, which is disposed farthest from the pressure-chamber surface may be greater than a distance between the pressure-chamber surface and a farthest portion, of a portion defining the connecting port, which is disposed farthest from the pressure-chamber surface. In this case, the partition-wall farthest portion, of the partition wall, which is disposed farthest from the pressure-chamber surface is formed at a position below or lower than a lower end of the connecting port. Accordingly, the gas, existing in the air damper chamber at a portion thereof located above or higher than the connecting port, does not flow to the common liquid chamber. Consequently, it is possible to prevent the liquid-droplet jetting characteristics from being changed or varied among the plurality of jetting ports due to the gas in flowed into the common liquid chamber.

In the liquid-droplet jetting apparatus of the present invention, with respect to the direction orthogonal to the pressure-chamber surface, a distance between the pressure-chamber surface and the upper wall surface of the common liquid chamber may be same as a distance between the pressure-chamber surface and the upper wall surface of the air damper chamber. In this case, it is possible to form the upper wall surface of the common liquid chamber and the upper wall surface of the air damper chamber easily by a single plane.

In the liquid-droplet jetting apparatus of the present invention, with respect to the direction orthogonal to the pressure-chamber surface, a distance between the pressure-chamber surface and the upper wall surface of the common liquid chamber may be greater than a distance between the pressure-chamber surface and the upper wall surface of the air damper chamber. In this case, the upper wall surface of the air damper chamber is positioned above or higher than of the upper wall surface of the common liquid chamber. Therefore, in the air damper chamber, a volume is increased in the air damper chamber at a portion thereof which is located above or higher than the upper end of the connecting port and in which the air exists. Due to the increase in the volume of this portion, the damper effect by the air is improved, thereby making it is possible to attenuate the pressure wave in the common liquid chamber even more efficiently.

In the liquid-droplet jetting apparatus of the present invention, with respect to the direction orthogonal to the pressure-chamber surface, the distance between the pressure-chamber surface and the partition-wall farthest portion of the partition wall may be same as a distance between the pressure-chamber surface and the upper wall surface of the common liquid chamber. In this case, since a channel cross-sectional area is not decreased between the common liquid chamber and the air damper chamber, the pressure wave is easily propagated from the common liquid chamber to the air damper chamber. Consequently, it is possible to attenuate the pressure wave even more efficiently by the air in the air damper chamber.

In the liquid-droplet jetting apparatus of the present invention, the air damper chamber and the common liquid chamber may have a same natural frequency. In this case, by making the natural frequency of the air damper chamber and the natural frequency of the common liquid chamber to be same, it is possible to prevent the liquid-droplet jetting characteristics among the jetting ports from changing or varying due to the pressure wave which is propagated to the common liquid chamber.

The liquid-droplet jetting apparatus of the present invention may further include an energy imparting mechanism which imparts a jetting energy to the liquid in the pressure chambers;

wherein the energy imparting mechanism may include a piezoelectric layer facing the pressure chambers, and at least one pair of electrodes which applies an electric field to the piezoelectric layer. In this case, it is possible to construct the energy imparting mechanism with a simple structure including the piezoelectric layer facing the pressure chambers, and at least one pair of electrodes which applies the electric field (jetting energy, discharge energy) to the piezoelectric layer.

DETAILED DESCRIPTION OF THE PREFERRED EMBODIMENTS

A preferred embodiment of the present invention will be explained in the following with reference to the accompanying diagrams. This embodiment is an example in which the present invention is applied to an ink-jet head which jets (discharges) an ink from nozzles.

Figure 1:
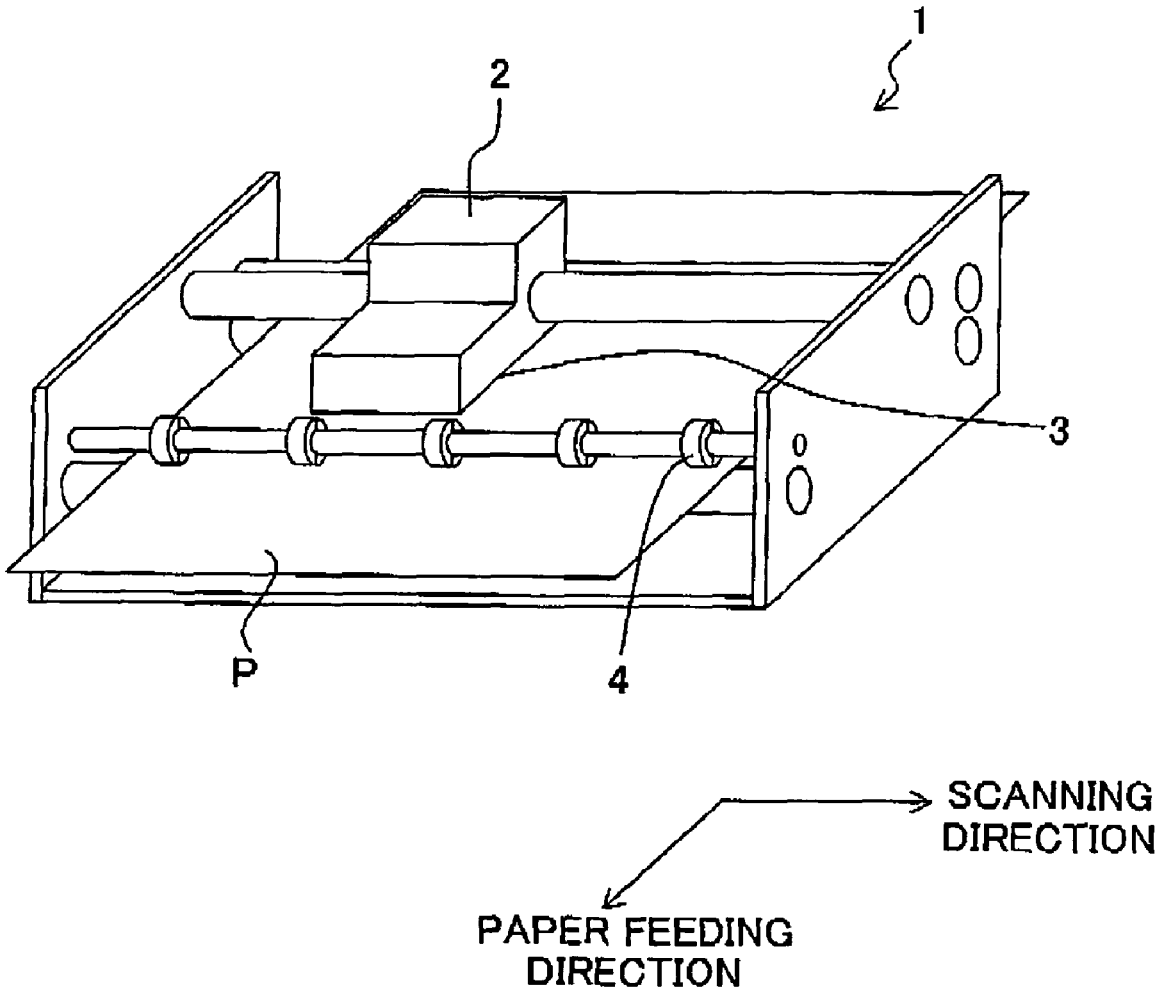
FIG. 1 is a schematic perspective view of an ink-jet printer according to an embodiment of the present invention.

FIG. 1 is a schematic perspective view of an ink-jet printer 1 according to the embodiment of the present invention. As shown in FIG. 1, the ink-jet printer 1 includes a carriage 2 which is movable in a scanning direction (left and right direction in FIG. 1), an ink-jet head (liquid-droplet jetting apparatus) 3 which is movable together with the carriage 2 and which jets an ink onto a recording paper P, and transporting rollers 4 which transport or feed the recording paper P in a paper feeding direction (forward direction in FIG. 1). The ink-jet head 3 performs printing on the recording paper P by jetting the ink from nozzles 16 (see FIG. 3) arranged on a lower surface of the ink-jet head 3, while moving integrally with the carriage 2 in the scanning direction. A large number of nozzles 16 is formed in the lower surface of the ink-jet head 3, and the lower surface is a nozzle surface. The recording paper P, with the printing performed thereon by the ink-jet head 3, is discharged in the paper feeding direction by the transporting rollers 4.

Figure 2:
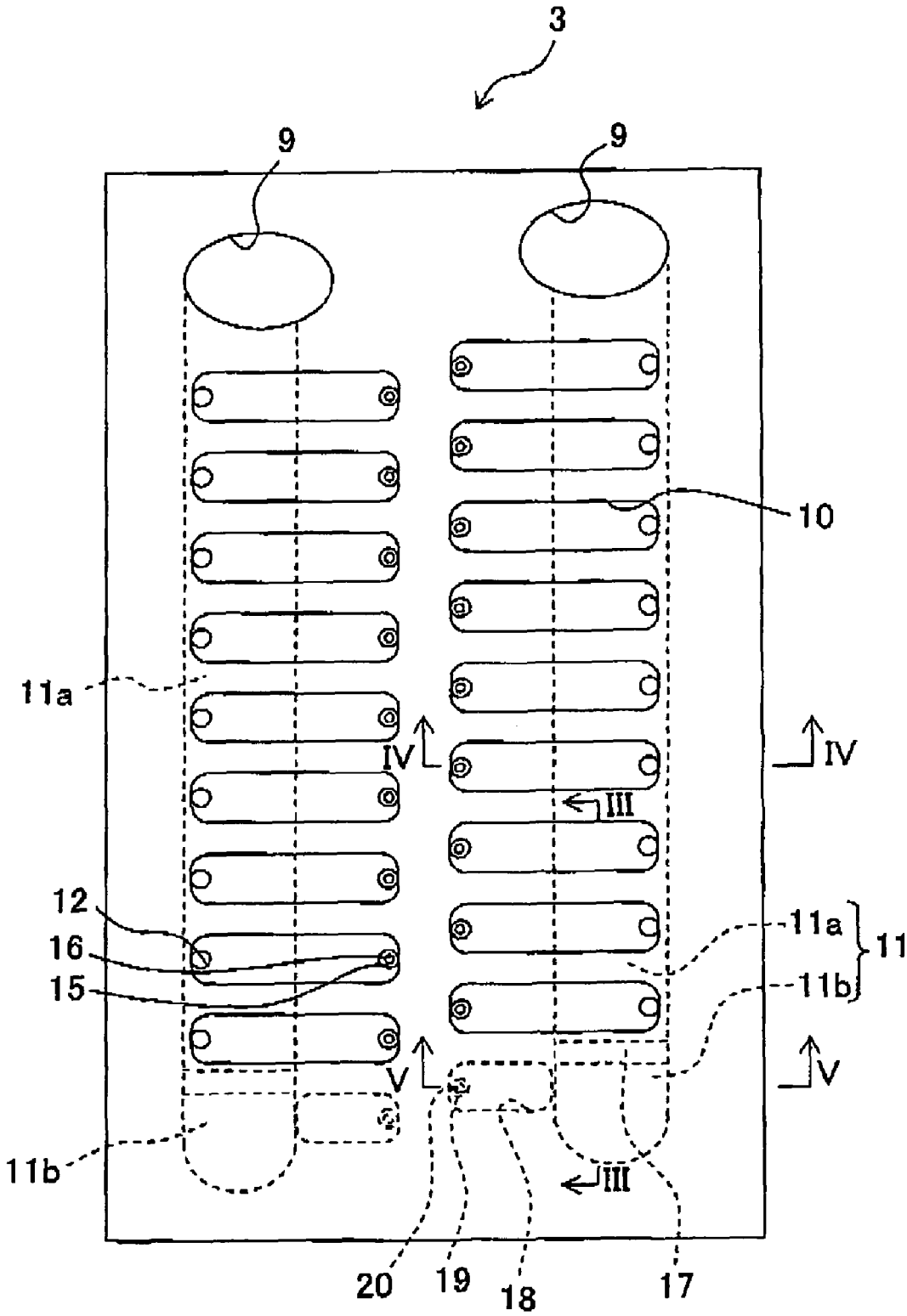
FIG. 2 is a plan view of the ink-jet head in FIG. 1.

Next, the ink-jet head 3 will be explained by using FIGS. 2 to 5. In FIG. 2, a piezoelectric actuator (energy imparting mechanism) 32 (see FIG. 3) is omitted.

As shown in FIGS. 2 to 5, the ink-jet head 3 includes a channel unit 31 in which an ink channel including pressure chambers 10 and manifold channels 11 and the like are formed; and the piezoelectric actuator 32 which is arranged on an upper surface of the channel unit 31 and which applies a pressure (imparts a jetting energy, discharge energy) to the ink in the pressure chambers 10.

The channel unit 31 includes a cavity plate 21, a base plate 22, an aperture plate 23, a first manifold plate 24, a second manifold plate 25, a damper plate 26, a spacer plate 27, and a nozzle plate 28. These eight plates 21 to 28 are joined in a stacked (layered) form. The seven plates 21 to 27, other than the nozzle plate 28, are substantially rectangular plates made of a metallic material such as stainless steel. Further, an ink channel including the pressure chambers 10, the manifold channels 11, and the like is formed in these plates 21 to 27 by an etching, The nozzle plate 28 is formed of a synthetic resin material such as polyimide, and is joined to a lower surface of the spacer plate 27. The nozzles 16 corresponding one to one to the pressure chambers 10 are formed in the nozzle plate 28 by a laser processing (to be described later). The nozzle plate 28 may also be formed of a metallic material similarly as the other plates 21 to 27.

Figure 3:
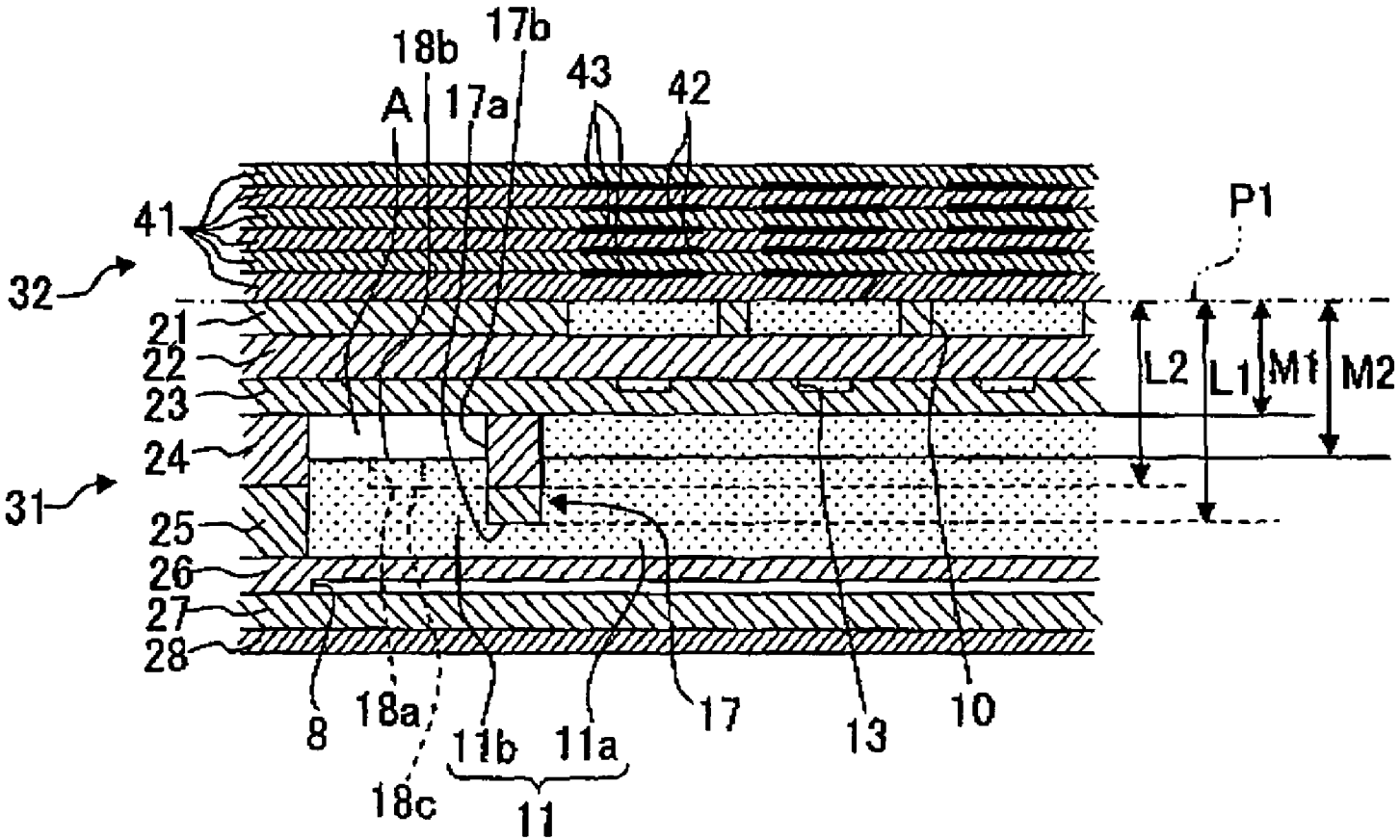
FIG. 3 is a cross-sectional view taken along a line III-III in FIG. 2.
Figure 4:
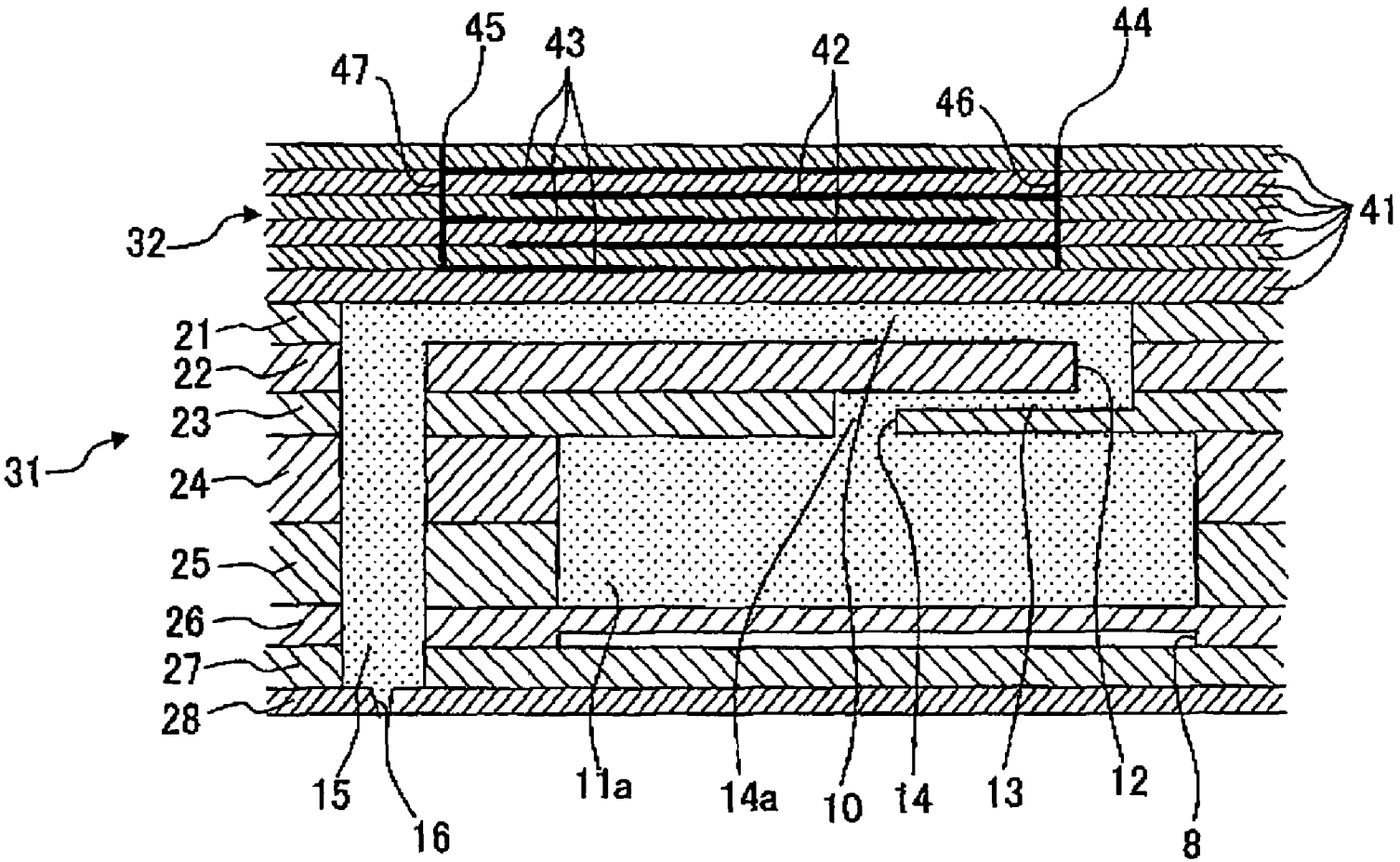
FIG. 4 is a cross-sectional view taken along a line IV-IV in FIG. 2.

As shown in FIGS. 2 to 4, in the cavity plate 21, 18 pieces of the pressure chambers 10 are formed and arranged in two rows in the paper feeding direction (up and down direction in FIG. 2) along a plane (pressure-chamber surface) P1. The pressure chambers 10 are formed to have a rectangular shape which is long in the scanning direction (left and right direction in FIG. 2) in a plan view. In the base plate 22, communicating holes 12 are formed at portions each of which overlaps in plan view with one end, in the longitudinal direction, of one of the pressure chambers 10. The communication holes 12 communicate the pressure chambers 10 with apertures 13 (to be described later), respectively. Further, communicating holes are formed in the base plate 22 at positions each overlapping in a plan view with the other end, in the longitudinal direction, of one of the pressure chambers 10. Each of the communicating holes forms a part of a channel 15 which communicates one of the pressure chambers 10 and one of the nozzles 16. In the aperture plate 23, the apertures 13, communicating holes 14 each of which communicates the manifold channel 11 and one of the apertures 13, and communicating holes each of which is to be a part of the channel 15 are formed. In each of the apertures 13, a channel cross-sectional area thereof is reduced (smaller) between the manifold channel 11 and one of the pressure chambers 10, so as to adjust an amount of ink which flows from the manifold channel 11 to the pressure chamber 10, to prevent a reverse flow of the ink from the pressure chamber 10 to the manifold channels 11, and the like. Furthermore, the apertures 23 suppress the propagation, to the manifold channels 11, of a pressure wave generated in the pressure chamber 10 when the pressure is applied to the ink in the pressure chamber 10 by the piezoelectric actuator 10. Further, a lower end of each of the communicating holes 14 is a connecting port 14*a* to the manifold channels 11.

Figure 5:
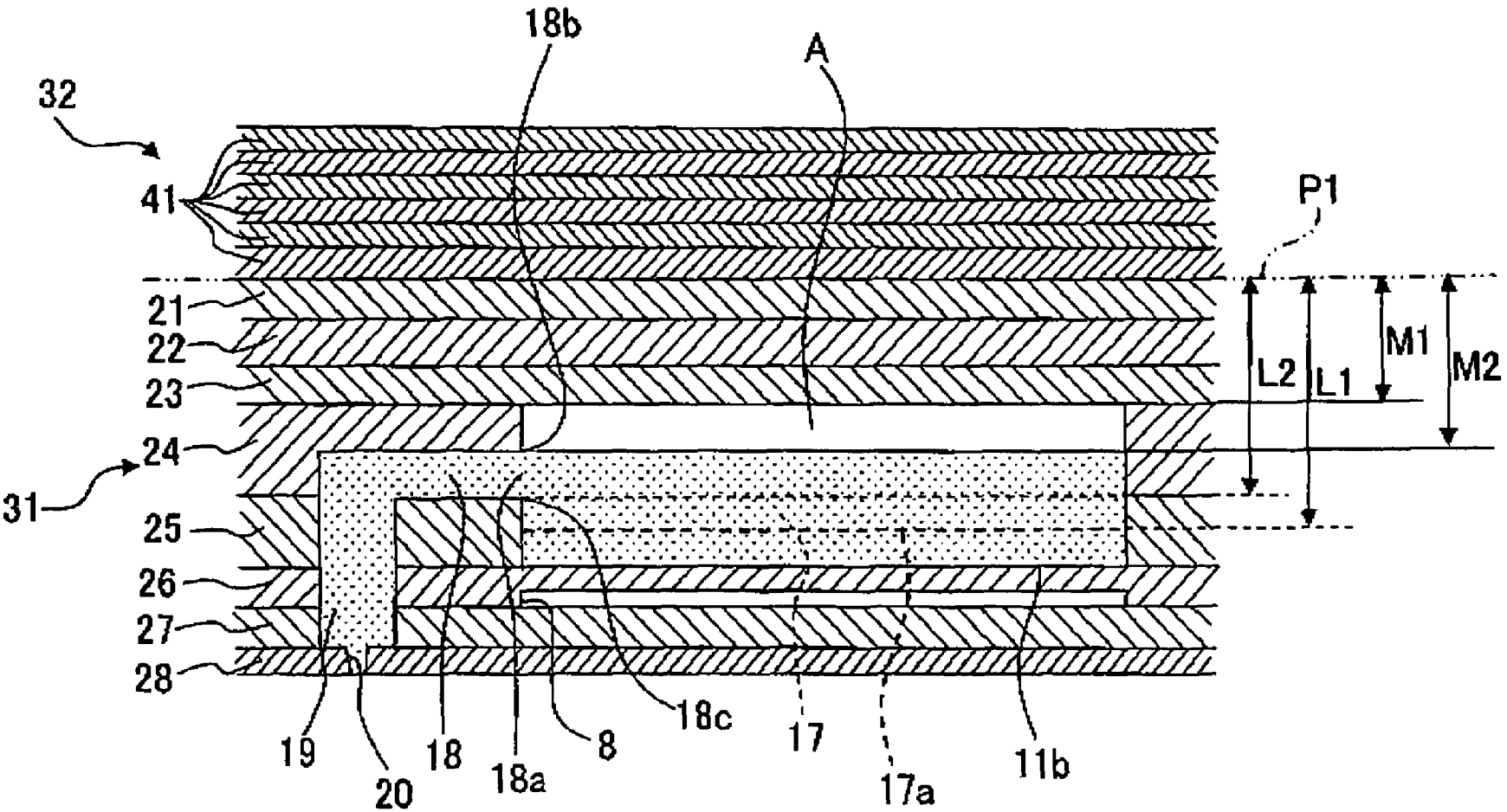
FIG. 5 is a cross-sectional view taken along a line V-V in FIG. 2.

In the first manifold plate 24, an upper half portion of each of the manifolds 11; communicating holes each of which forms a part of the channel 15, and a channel 18 which communicates one of the manifold channels 11 and a dummy nozzle 20 (to be described later) are formed. Here, a right end of the channel 18 in FIG. 5 is a connecting port 18*a* to the manifold 11. In the second manifold plate 25, a lower half portion of each of the manifold channels 11, communicating holes each of which constructs a part of the channel 15, and communicating holes each of which forms a part of a channel 19 communicating the channel 18 and the dummy nozzle 20. Further, by joining the first manifold plate 24 and the second manifold plate 25 together, two pieces of the manifold channels 11 are formed. As shown in FIG. 2, each of the manifold channels 11 is extended in the paper feeding direction. In a plan view, each of the pressure chambers 10 is arranged three-dimensionally such that the pressure chamber 10 overlaps with the manifold channel 11 partially, at a portion thereof on a side to which the ink is supplied (side of the communicating hole 12). The pressure chambers 10 are arranged such that an end portion, at the side of nozzle 16, of a pressure chamber 10, which is included in the pressure chambers 10 and which overlaps in a plan view with one of the manifold channels 11, faces an end portion on the side of nozzle 16 of another pressure chamber 10 overlapping in a plan view with the other of the manifold channels 11. The nozzles 16 are arranged to form two nozzle rows in an area defined by the two manifold channels 11 substantially at the center of the area.

The ink is supplied to the two manifold channels 11 from ink inflow ports 9 respectively. Each of the ink inflow ports 9 is formed at one end portion (end portion at an upper side in FIG. 2) of one of the manifold channels 11. Further, a projection 17, which extends from the upper surface of each of the manifold channels 11 in a downward direction in the manifold channel 11 (projected from the upper wall surface toward the lower wall surface of the manifold channel 11), is formed in each of the manifold channels 11. A height (length in an up and down direction in FIG. 3) of each of the manifold channels 11 is partially reduced in this portion in which the projection 17 is formed. In other words, a left side surface 17*b* of the projection 17 in FIG. 3 is a surface, on the upper wall surface, which forms or defines a step (hereinafter referred to as "step-surface"). Further, by partitioning (dividing) each of the manifold channels 11 with the step-surface 17*b* of the projection 17, a first area 11*a* and a second area 11*b* are formed. In the first area 11*a*, the connecting ports 14*a* communicating with the pressure chambers 10 respectively are formed. The second area 11*b* is adjacent to the first area 11*a* at an end portion of the first area 11*a* on a side opposite to the ink inflow port 9 (lower side in FIG. 2), with the projection 17 being intervened therebetween. Further, in the second area 11*a*, the connecting port 18*a* communicating with the dummy nozzle 20 is formed. In other words, the ink inflow ports 9, the first area 11*a* connecting to (communicating with) the ink inflow port 9, the projection 17, and the second area 11*b* connecting to (communicating with) the first area 11*a*, via the step-surface 17*b* of the projection 17, are formed along the paper feeding direction in each of the manifold channels 11 in the above order from the upper side in FIG. 2. Here, an upper portion of the projection 17 is formed in the first manifold plate 24, and a lower portion of the projection 17 is formed in the second manifold plate 25; and the projection 17 is formed by joining the first manifold plate 24 and the second manifold plate 25. In the projection 17, the portion thereof formed in the second manifold plate 25 is formed as a thin-walled portion by performing half-etching on a base material, so as to construct a rectangular-shaped communicating channel which communicates the first and second areas 11*a*, 11*b* located at both sides, respectively, of the projection 17. A portion, on the lower surface of the aperture plate 23, which overlaps with the manifold channel 11 corresponds to the upper wall surface according to the present invention. Further, a portion, on the upper surface of the damper plate 26, which overlaps with the manifold channel 11 corresponds to the lower wall surface according to the present invention. The connecting ports 14*a* are formed in the upper wall surface.

The ink which flowed into each of the manifold channels 11 from one of the ink inflow ports 9 hardly flows to an end portion, of the manifold channel 11, on a side opposite to the ink inflow port 9, and an air bubble is easily remained or stagnated at an end portion, of the manifold channel 11, on a side opposite to the ink inflow port 9. On the other hand, when air bubble is flowed into the pressure chamber 10, the jetting characteristics of ink (ink-jetting characteristics) from a nozzle 16 communicating with the pressure chamber 10 are varied or changed. However, in this embodiment, the portion of the manifold channel 11 at the end thereof on the side opposite to the ink inflow port 9 is the second area 11*b*, and the connecting ports 14*a* communicating with the pressure chambers 10 respectively are not formed in this second area 11*b*. Therefore, the air bubble is flowed to the second area 11*b* and becomes a part of air A (to be described later). Further, the second area 11*b* and the first area 11*a* are partitioned by the projection 17, or more specifically, are partitioned by the step-surface 17*b* of the projection 17. Therefore, the air A in the second area 11*b* does not flow into the first area 11*a* in which the connecting ports 14*a* communicating with the pressure chambers 10 respectively are formed. Consequently, the air bubble does not flow to the pressure chambers 10.

As shown in FIG. 5, the connecting port 18*a* in the channel 18 is formed in a lower portion of the first manifold plate 24. Therefore, the ink flowed into the second area 11*b* flows to the channel 18 through the connecting port 18*a*, but does not flow to a portion, of the second area 11*b*, which is located above or higher than an upper end 18*b* of the connecting port 18*a*. Further, since the projection 17 is provided between the first area 11*a* and the second area 11*b*, the ink does not flow to the second area from a portion, of the first area 11*a*, which is located above or higher than a end portion 17*a* of the projection 17. Furthermore, the upper end 18*b* (portion disposed closest or nearest to the plane P1) of the connecting port 18*a* is positioned below or lower than the upper surface of the second area 11*b* (is separated from the upper wall surface of the second area 11*b*). In other words, a distance M1 between the upper surface of the second area 11*b* and the plane (pressure-chamber surface) P1 which is formed by the pressure chambers 10 being arranged along the manifold channel 11 is smaller (shorter) than a distance M2 between the plane P1 and the upper end 18*b* of the connecting port 18*a*. Consequently, the ink does not exist in a portion, of the second area 11*b*, located above or higher than the upper end 18*b* of the connecting port 18*a*, and the air A exists in this portion of the second area 11*b*. The air A is in a direct contact with the ink in the manifold channel 11, and forms a gas-liquid interface. Further, since the lower portion of the projection 17 is formed in the second manifold plate 25, the end portion 17*a* of the projection 17 is positioned below or lower than a lower end 18*c* of the connecting port 18*a*. In other words, a distance L1 between the plane P1 and the end portion 17*a*, of the projection 17, which is located farthest from the plane P1 is greater (longer) than a distance L2 between the plane P1 and the lower end 18*c*, of the connecting port 18*a*, located farthest from the plane P1. Therefore, the air A in the second area 11*b* does not flow to the first area 11*a*. It is desirable that the portion, of the second area 11*b*, in which the air A exists, has a volume in a range of about 20% to 70% of a total volume of the second area 11*b*.

As described above, each of the manifold channels 11 has a structure in which the first area 11*a*, into which the ink to be distributed to the pressure chambers 10 is filled, and the second area 11*b*, in which a gas-liquid (air-liquid) contact surface on which the air A and the ink make a contact, are partitioned (the manifold channel 11 is divided into the first area 11*a* and the second area 11*b*) by the step-surface 17*b*. In other words, the second area 11*b* functions as a damper chamber (air damper chamber) having a cavity, and is connected to the first area 11*a* which is extended to be elongated, via a rectangular tube-shaped communicating channel formed by the projection 17.

In general, when a cavity is connected, by a short pipe (tube), to an acoustic tube having a sufficiently great length at an intermediate portion of the acoustic tube, then an natural frequency (characteristic frequency) $f_0$ of the cavity is expressed by the following expression 1, in which a volume of the cavity is W; a compliance of the cavity is $C_A$ ($=W/\rho c^2$); a length of the short tube is 1; a cross-sectional area of the short tube is S; and an inner size of the short tube is be $m_A$ ($=\rho 1/S$):

$$f_0 = \frac{1}{2\pi\sqrt{m_A c_A}} = \frac{c}{2\pi}\sqrt{\frac{S}{lW}} \quad \text{[Expression 1]}$$

Here, ρ represents a density of a liquid, and c represents a velocity of sound in the liquid. Therefore, for example, by setting the size (length "1" and cross-sectional area "S") of the short tube and the volume of the cavity "W" such that "$f_0$" nearly or substantially matches (is almost equal to) a jetting drive frequency, it is possible to easily attenuate a pressure wave having the drive frequency which is generated directly by the jetting action (jetting operation). Further, by setting each of the dimensions such that "$f_0$" is nearly equal to a natural frequency of the first area 11*a*, it is possible to easily attenuate the pressure wave, having the natural frequency of the first area 11*a*, which is induced by the jetting operation.

Recesses 8 are formed in the lower surface of the damper plate 26 at portions thereof overlapping in a plan view with the manifold channels 11, respectively. The thickness of the damper plate 26 is reduced at the portions thereof in which the recesses 8 are formed, and by deforming these portions of the damper plate 26, the pressure wave in the manifold channels 11 is attenuated. Further, communicating holes each forming a part of one of the channels 15 and communicating holes each forming a part of one of the channels 19 are formed in the damper plate 26. The spacer plate 27 is arranged to close openings of the recesses 8 formed in the lower surface of the damper plate 26. In the spacer plate 27, communicating holes each forming a part of one of the channels 15 and communicating holes each forming a part of one of the channels 19 are formed.

In the nozzle plate 28, the plurality of nozzles 16 is formed at positions overlapping in a plan view with the plurality of channels 15, respectively. Further, a plurality of dummy nozzles 20 is formed in the nozzle plate 28 at positions overlapping in a plan view with the plurality of channels 19 respectively. Jetting ports of the nozzles 16 and jetting ports of the dummy nozzles 20 are opened in the lower surface of the nozzle plate 28. The dummy nozzles 20 are formed, continuously on an extension line of a nozzle line formed by the nozzles 16, on a side of one end on the extension line. When the nozzle plate 28 is made of a synthetic resin material, it is possible to form the nozzles 16 and the dummy nozzles 20 by an excimer laser process; and when the nozzle plate 28 is made of a metallic material, it is possible to form the nozzles 16 and the dummy nozzles 20 by a press working using a punch.

As explained above, each of the manifold channels 11 communicates with the pressure chambers 10 via the communicating holes 14, the apertures 13, and the communicating holes 12, respectively. Each of the pressure chambers 10 further communicates with one of the nozzles 16 via one of the channels 15. Further, each of the manifold channels 11 communicates with one of the dummy nozzles 20 via the channels 18 and 19. Thus, in the channel unit 31, a plurality of first individual ink channels each from one of the connecting ports 14*a* up to one of the nozzles 16 via one of the pressure chambers 10; and a plurality of second individual ink channels each from one of the connecting ports 18*a* up to one of the dummy nozzles 20 are formed. Here, a channel resistance in each of the second individual ink channels is smaller (lower) than a channel resistance in each of the first individual ink channels. Furthermore, the channel resistance in each of the second individual ink channels is smaller than a channel resistance obtained by combining channel resistance in all the first individual ink channels at the first area 11*a* (channel resistance obtained by combining all the channel resistance in all the first individual ink channels is smaller than the channel resistance in each first individual ink channels). Accordingly, when the ink flows from each of the manifold channels 11 to the pressure chambers 10, the ink flows into the second individual ink channel more easily than to all the first individual ink channels. The second individual ink channel is arranged at a side opposite to the ink inflow port 9, with respect to each of the manifold channels 11. Consequently, at least in a first area 11*a*, among the first areas 11*a*, which is located at an intermediate position in the route, the ink is filled assuredly to the first area 11*a* without the air bubble remaining therein. Each of the first individual ink channels communicating with one of the first areas 11*a* is also filled satisfactorily with ink in the similar manner. It is preferable that the channel resistance in the second individual ink channel is about 10% to 80% of the channel resistance in the first individual ink channel.

Next, the piezoelectric actuator 32 will be explained below. As shown in FIGS. 3 to 5, the piezoelectric actuator 32 includes six piezoelectric layers 41 arranged on the upper surface of the channel unit 31, and two individual electrodes 42 and three common electrodes 43 which are formed alternately between the six piezoelectric layers 41.

The piezoelectric layer 41 is made of a piezoelectric material which is mainly composed of lead zirconate titanate (PZT) which is a solid solution of lead titanate and lead zirconate, and is a ferroelectric substance. Among the six piezoelectric layers 41, a lowermost piezoelectric layer 41 is arranged on the upper surface of the cavity plate 21 continuously so as to cover the plurality of pressure chambers 10, and is joined to the cavity plate 21. Furthermore, five piezoelectric layers 41 are stacked in laminated form on this lowermost piezoelectric layer 41. It is possible to form the piezoelectric layer 41 by, for example, an aerosol deposition method (AD method) in which very small particles of PZT are blown and collided onto a substrate at a high speed, so as to deposit the particles onto the substrate. Alternatively, it is also possible to form the piezoelectric layer 41 by a method such as a sputtering method, a chemical vapor deposition method (CVD method), a sol-gel method, a hydrothermal synthesis method, or the like. Still alternatively, it is also possible to form the piezoelectric layer 41 by baking a green sheet of a piezoelectric material to obtain a piezoelectric sheet, then by cutting the piezoelectric sheet to a predetermined size, and then by sticking or adhering the cut sheet or sheets to the cavity plate 21. Here, the piezoelectric layer 41 obtained from the green sheet is fixed to the cavity plate 21 by a thermosetting adhesive.

The individual electrodes 42 and the common electrodes 43 are arranged alternately between the stacked piezoelectric layers 41. The individual electrode 42 and the common electrode 43 are each formed of an electroconductive material such as gold, copper, silver, platinum, titanium, or the like by a method such as a screen printing, the sputtering method, a vapor deposition method, or the like. Further, the individual electrodes 42 and the common electrodes 43 are arranged to be mutually shifted in a plan view in the left and right direction in FIG. 4. Here, each of the individual electrodes 42 and the common electrodes 43 is formed of an Ag-Pd electroconductive material, by the screen printing.

Through holes 44 are formed in the five piezoelectric layers 41, excluding the lowermost piezoelectric layer 41, at positions each overlapping in a plan view with the individual electrodes 42 but not overlapping in a plan view with none of the common electrodes 43; and an electroconductive material 46 is filled in the through holes 44. Further, through holes 45 are formed in the piezoelectric layer 41 at positions each overlapping in a plan view with the common electrodes 43, but not overlapping in a plan view with none of the individual electrodes 42; and an electroconductive material 47 is filled in the through holes 45. As shown in FIGS. 3 and 5, the individual electrodes 42 and the common electrodes 43 as explained above are formed corresponding to each of the pressure chambers 10 communicating with the first area 11*a*; but none of the individual electrodes 42 and the common electrodes 43 is formed at a portion facing the second area 11*b*. Accordingly, the cost reduction of the piezoelectric actuator 32 is thus realized.

A flexible printed circuit (FPC), which is not shown in the diagram, is arranged on the upper surface of the piezoelectric actuator 32, the individual electrodes 42 and the common electrodes 43 are electrically connected to the FPC via the electroconductive materials 46 and 47, respectively. Further, an electric potential of the individual electrode 42 is controlled, via the FPC, by a driver IC (not shown in the diagram), and the common electrode 43 is kept at a ground electric potential all the time. Here, the electroconductive materials 46 and 47 may be connected directly to the FPC. Alternatively, it is also allowable that surface electrodes are provided, independently for the electroconductive material 46 and 47 respectively, on the uppermost surface of the piezoelectric actuator 32; and that the FPC is connected to these surface electrodes.

Next, operation of the piezoelectric actuator 32 will be explained below. When a predetermined electric potential is applied selectively to the individual electrodes 42 via the FPC, there is an electric potential difference between a certain individual electrode 42 to which the predetermined electric potential is applied and the common electrode 43 which is kept at the ground electric potential, and an electric field in a direction of thickness of the piezoelectric layer 41 (thickness direction) is generated in a portion of the piezoelectric layer 41 sandwiched between the individual electrode 42 and the common electrode 43. Here, when a direction in which the piezoelectric layer 41 is polarized is same as the direction of the generated electric field, the piezoelectric layer 41 is elongated or expanded in the thickness direction due to the vertical piezoelectric effect. Accordingly, a volume of a pressure chamber 10 corresponding to the certain individual electrode 42 is decreased to increase the pressure of the ink in the pressure chamber, thereby jetting the ink from a nozzle 16 communicating with the pressure chamber 10. In this embodiment, six pieces of the piezoelectric layer 41 are stacked in laminated form, and among these six piezoelectric layers 41, five piezoelectric layers 41 other than the lowermost piezoelectric layer 41 are elongated or expanded in the thickness direction. Accordingly, the volume of the pressure chamber 10 is decreased sufficiently.

At this time, a pressure wave is generated in the pressure chamber 10, and this pressure wave is propagated to the manifold channel 11 communicating with the pressure chamber 10. At this time, the damper plate 26, forming a bottom surface of the manifold channel 11, is deformed at a portion thereof of which thickness is decreased by the recess 8 formed therein, so as to attenuate the pressure wave propagated to the manifold channel 11. However, when the manifold channel 11 is small in size, the portion of the damper plate 26, in which the recess 8 is formed, consequently becomes small as well. Therefore, it is not possible to attenuate the pressure wave sufficiently.

In this embodiment, however, the air A exists in the second area 11*b* of the manifold channel 11, and this air A is in contact with the ink in the second area 11*b*, thereby forming a gas-liquid interface. In other words, as shown in FIG. 2, the gas-liquid interface overlaps in a plan view entirely with the second area 11*b* of each of the manifold channels 11. Here, since the stiffness of the air A is smaller (lower) than the stiffness of the portion, of the damper plate 26, in which the recess 8 is formed, it is possible to efficiently attenuate the pressure wave in the manifold channel 11 by the air A.

According to the embodiment as explained above, the first area 11*a* and the second area 11*b* are formed in the manifold channel 11 while sandwiching the projection 17 therebeween; and the end portion 17*a* of the projection 17 is formed to be positioned below or lower than the lower end 18*c* of the connecting port 18*a* of the channel 18. Therefore, the ink does not flow to a portion of the second area 11*b* above or higher than the connecting port 18*a*, and the air A exists in this portion. Further, since the air A is in contact with the ink in the manifold channel 11, the air A acts as a damper which attenuates the pressure wave in the manifold channel 11. Furthermore, since the end portion 17*a* of the projection 17 is positioned below or lower than the lower end 18*c* of the connecting port 18*a* of the channel 18, the air A does not flow from the second area 11*b* to the first area 11*a*.

Further, each of the manifold channels 11 is extended in the paper feeding direction. Further, the ink inflow port 9; the first area 11*a* having the connecting ports 14*a* of the channels 14 (first individual ink channels) formed therein; the projection 17; and the second area 11*b* having the connecting port 18*a* of the channel 18 (second individual ink channel) formed therein, are formed along the paper feeding direction in this order from the upper side in FIG. 2. Each of the second individual ink channels, having a small channel resistance, is communicated with the end portion, of one of the manifold channels 11, which is located on the side opposite to the ink inflow port 9, through which the ink does not easily flow and in which the air bubble easily remains. Accordingly, the air bubble hardly remains at least in the first area 11*a*, and the air bubble does not easily flow into the pressure chambers 10 communicating with the first area 11*a*. In other words, the ink flows assuredly to the pressure chambers 10 which are directly associated with the ink jetting.

Further, in this embodiment, the first area 11*a* and the second area 11*b* are mutually separated (partitioned) by the projection 17 so as to form in the second area 11*b* a cavity in which the air bubble remains, thereby making the second area 11*b* to function as the air damper chamber, and to make the natural frequency of the first area 11*a* and the natural frequency of the second area 11*b* to be the same. Therefore, it is possible to efficiently attenuate the pressure wave generated in the manifold channel 11, thereby preventing the jetting characteristics of ink from being changed or varied. Alternatively, by constructing the projection 17 such that the natural frequency in an area ranging from the projection 17 and up to the second area 11*b* is close to the drive frequency, it is also possible to effectively attenuate the pressure wave directly propagated from the pressure chamber 10 by the ink-jetting operation. Accordingly, it is also possible to prevent the jetting characteristics of ink from being changed or varied.

Next, modifications in which various modifications are made to the embodiment will be explained below. However, same reference numerals are used for parts or components which have the same structure as those in the embodiment, and the explanation therefor will be omitted as appropriate.

Figure 6:
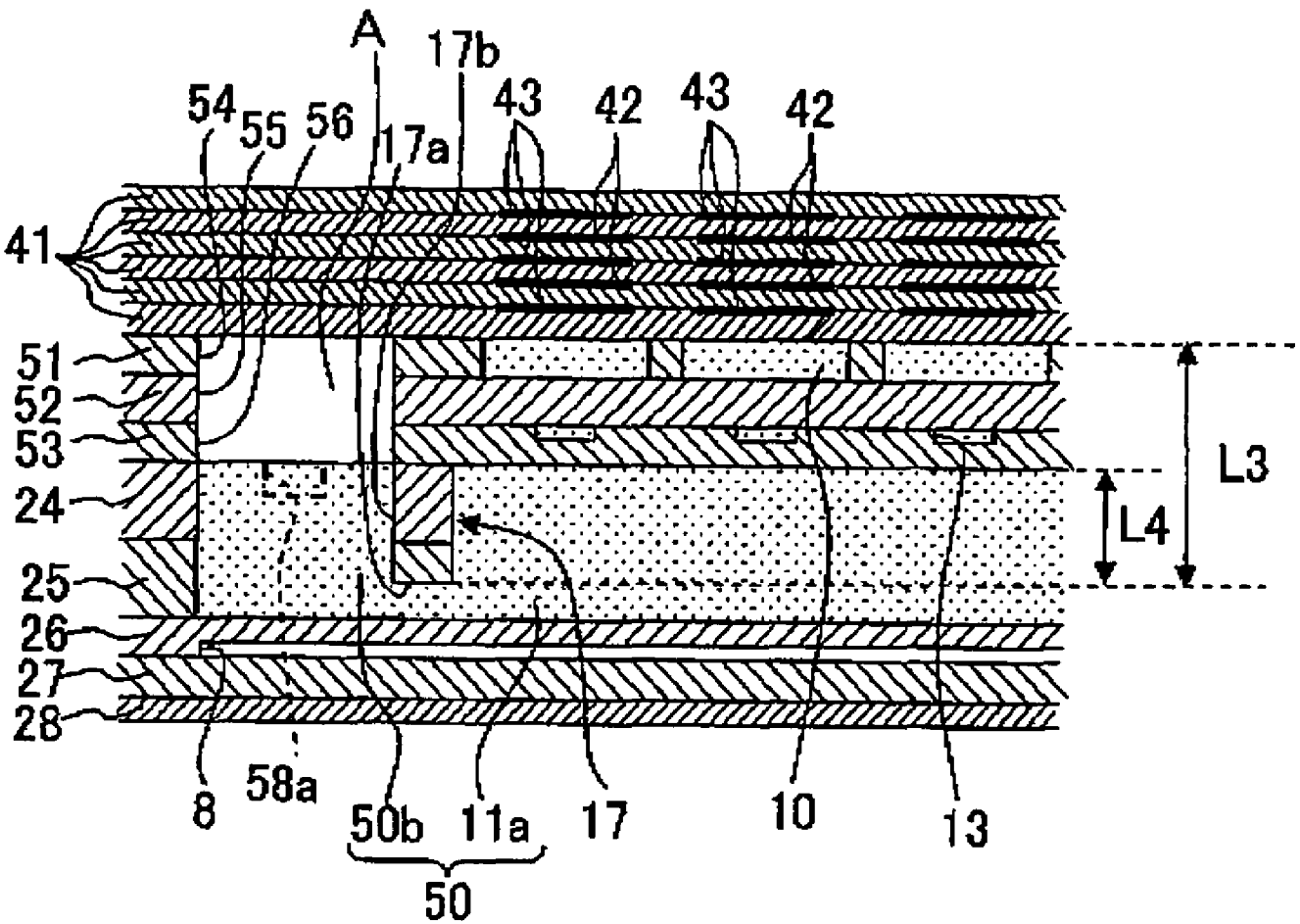
FIG. 6 is a cross-sectional view of a first modification, corresponding to FIG. 3.
Figure 7:
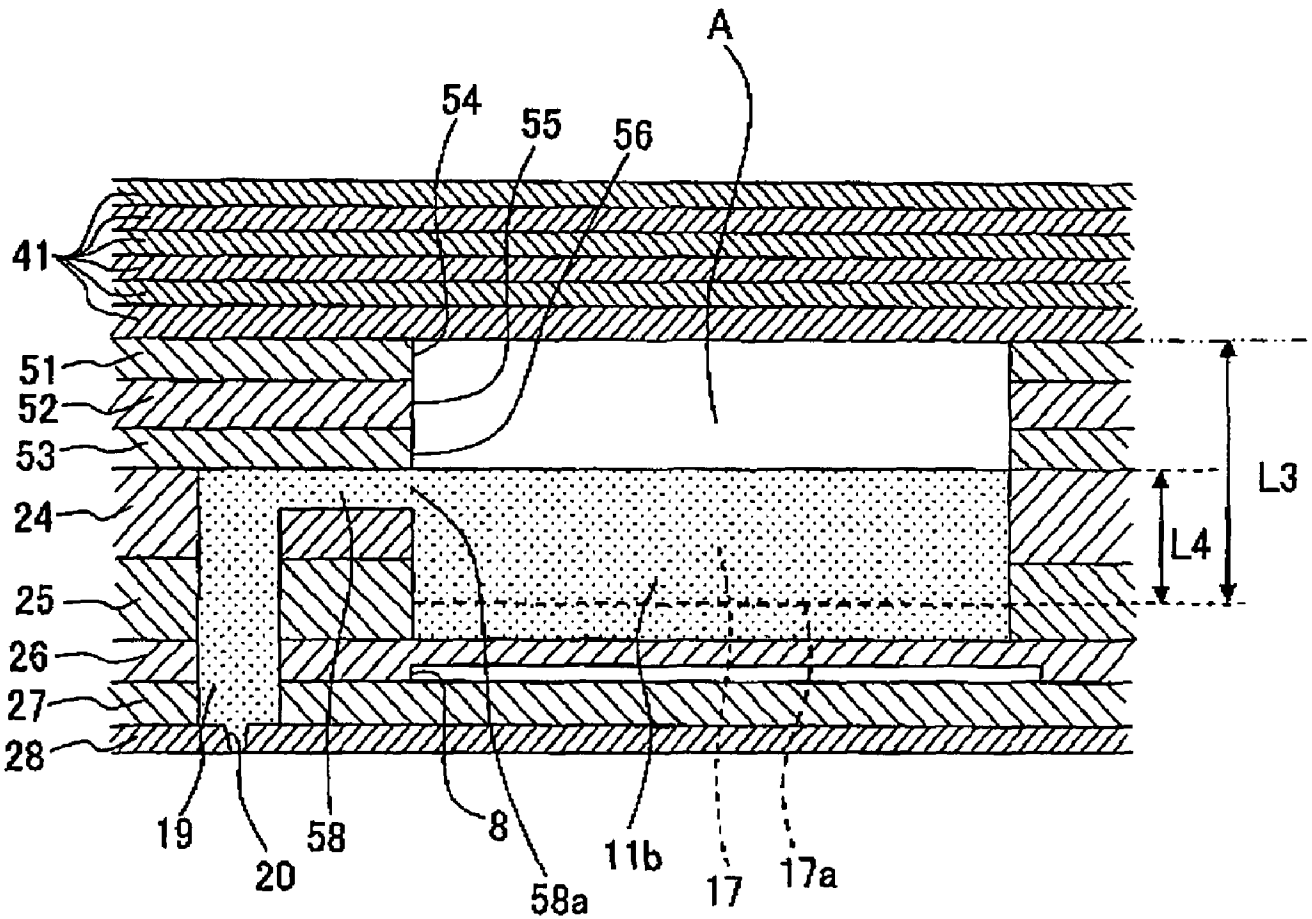
FIG. 7 is a cross-sectional view of the first modification, corresponding to FIG. 5.

In a first modification, as shown in FIGS. 6 and 7, through holes 54, 55, and 56 which are to be a part of a second area 50*b* are formed in each of a cavity plate 51, a base plate 52, and an aperture plate 53 at an area which overlaps in a plan view with the second area 11*b* (see FIGS. 3 and 5) of the above-described embodiment. In this case, an upper surface of the second area 50*b* becomes a lower surface of the piezoelectric layer 41 which is located above or higher than the lower surface of the aperture plate 23 (see FIG. 3) in the above-described embodiment. In other words, a distance L3 between the end portion 17*a* of the projection 17 and the upper surface of the second area 50*b* is greater or longer than a distance L4 between the projection 17 and the upper surface of the first area 11*a*. Accordingly, a degree of freedom with respect to a volume of a portion, of the second area 50*b*, in which the air A exists is improved, and it is possible to easily set the natural frequency $f_0$ corresponding to the pressure wave which is an object of attenuation. In other words, it is possible to attenuate the pressure wave in the manifold channel 11 by the air A even more efficiently. In the first modification, a channel 58 is formed in an upper portion of the manifold plate 24, and the channel 58 communicates with the manifold channel 11 at a connecting port 58*a*.

Figure 8:
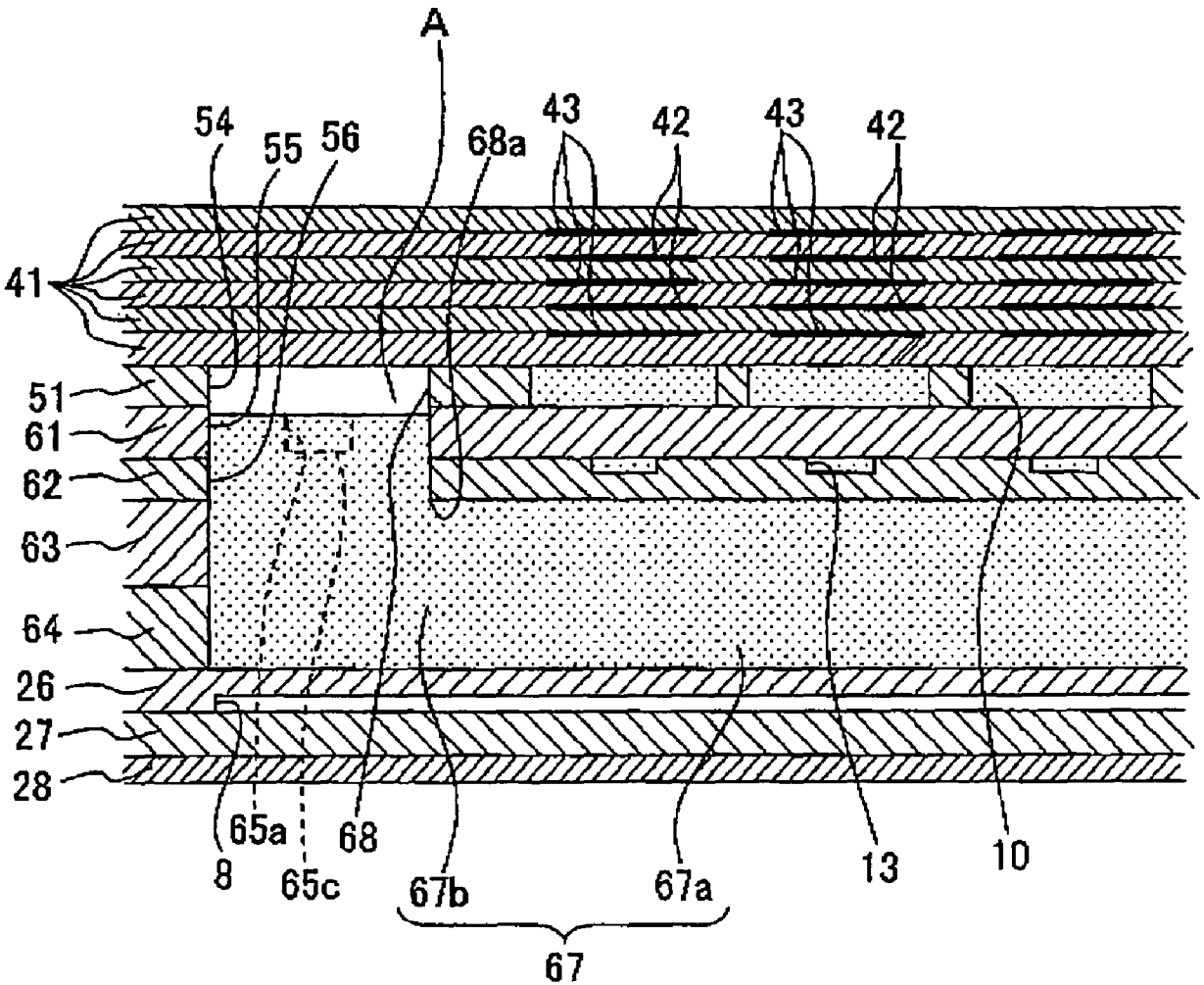
FIG. 8 is a cross-sectional view of a second modification, corresponding to FIG. 3.
Figure 9:
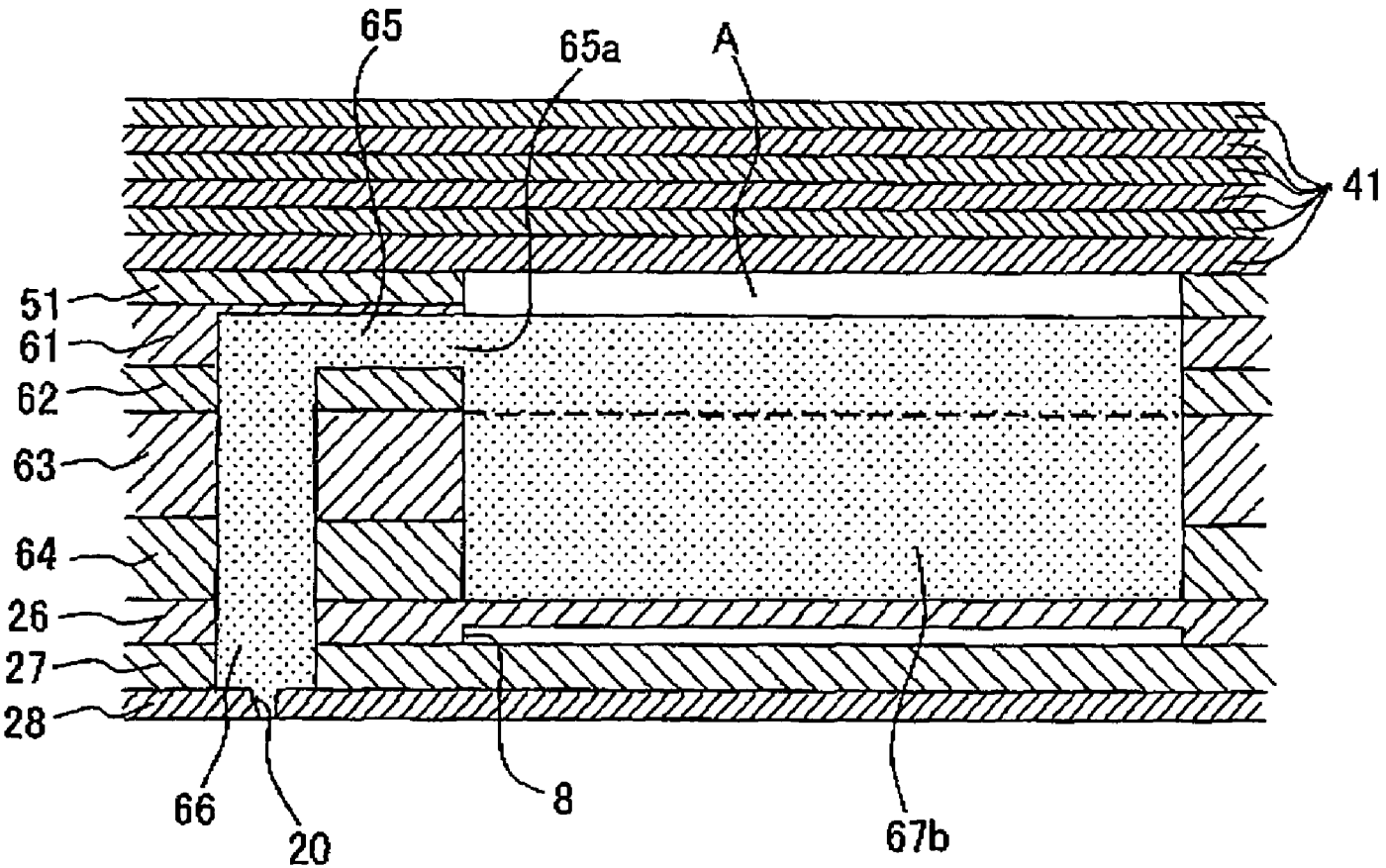
FIG. 9 is a cross-sectional view of the second modification, corresponding to FIG. 5.

A second modification is same as the first modification in that, as shown in FIGS. 8 and 9, through holes 54, 55 and 56 which are to be a part of a second area 67*b* are formed in each of the cavity plate 51, a base plate 61, and an aperture plate 62 at an area which overlaps in a plan view with the second area 11*b* of the embodiment (see FIGS. 3 and 5). On the other hand, the second modification is different from the above-described embodiment and the first modification in that any projection is not formed in the manifold plates 63 and 64. A connecting port 65*a*, of a channel 65 which communicates with a manifold channel 67 and a channel 66, is formed on a lower surface of the base plate 61; and right end side surfaces of the through holes 54, 55, and 56 in FIG. 8 forms a step-surface 68. In this case, since the projection is not formed in the manifold channel 67, a distance between the plane P1 (see FIG. 3) and a lower end 68*a* of the step-surface 68 and a distance between the plane P1 (see FIG. 3) and an upper surface of the first area 67*a* are same. In the manifold channel 67, the first area 67*a* having the plurality of connecting ports 14*a* (see FIG. 4) formed therein, and a second area 67*b* having the connecting port 65*a* of the channel 65 formed therein, are formed, sandwiching the step-surface 68 between the first and second areas 67*a*, 67*b*. Accordingly, since there is no portion with a reduced channel cross-sectional area between the first area 67*a* and the second area 67*b*, the pressure wave is easily propagated from the first area 67*a* to the second area 67*b*. Consequently, it is possible to attenuate the pressure wave even more efficiently by the air A in a portion located above or higher than the connecting port 65*a* of the second area 67*b*.

Furthermore, in this case, since the connecting port 65*a* is formed on the lower surface of the base plate 61 which is arranged above or higher than the manifold plate 63, a lower end 65*c* of the connecting port 65*a* is consequently positioned above or higher than the upper surface of the first area 67*a*, with respect to the up and down direction in FIG. 8. Accordingly, the air A existing in the portion, of the second area 67*b*, above or higher than the connecting port 65*a* does not inflow into the first area 67*a*. Further, in this case, as shown in FIG. 9, a communicating hole, which is to be a part of the channel 66, is formed in each of the base plate 61, the aperture plate 62, and the manifold plates 63 and 64. In this case, it is possible to adjust an opening size (dimension) in the aperture plate 62 with respect to the manifold channel 67 so that the second area 67*b* has a natural frequency $f_0$ with respect to the pressure wave which is to be attenuated.

Figure 10:
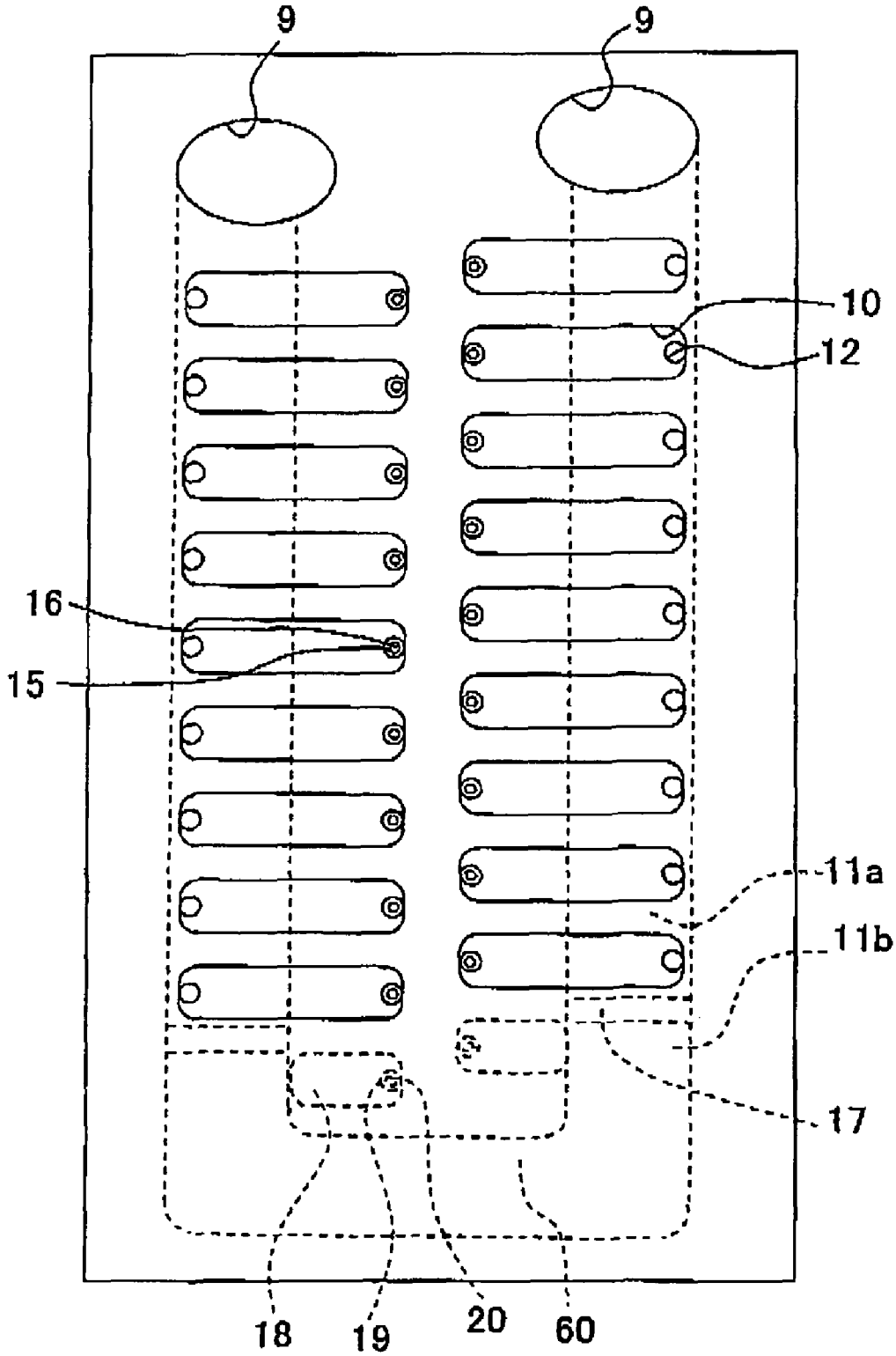
FIG. 10 is a plan view of a third modification, corresponding to FIG. 2.

In a third modification, when a same type of the ink is jetted from adjacent manifold channels 11 respectively, then as shown in FIG. 10, a connecting channel 60 which connects second areas 11*b* of the adjacent manifold channels 11 is formed. In this case, it is possible to attenuate the pressure wave in one of the manifold channels 11 by the air A in a second area 11*b* of the manifold channel 11. Further, it is possible to attenuate the pressure wave, propagated from the second area 11*b* of this manifold channel 11 to the other manifold channel 11 adjacent to the manifold channel 11 through the connecting channel 60, by the air A in the second area 11*b* of the adjacent manifold channel 11. Consequently, it is possible to attenuate the pressure wave in the manifold channel 11 even more efficiently.

Figure 11:
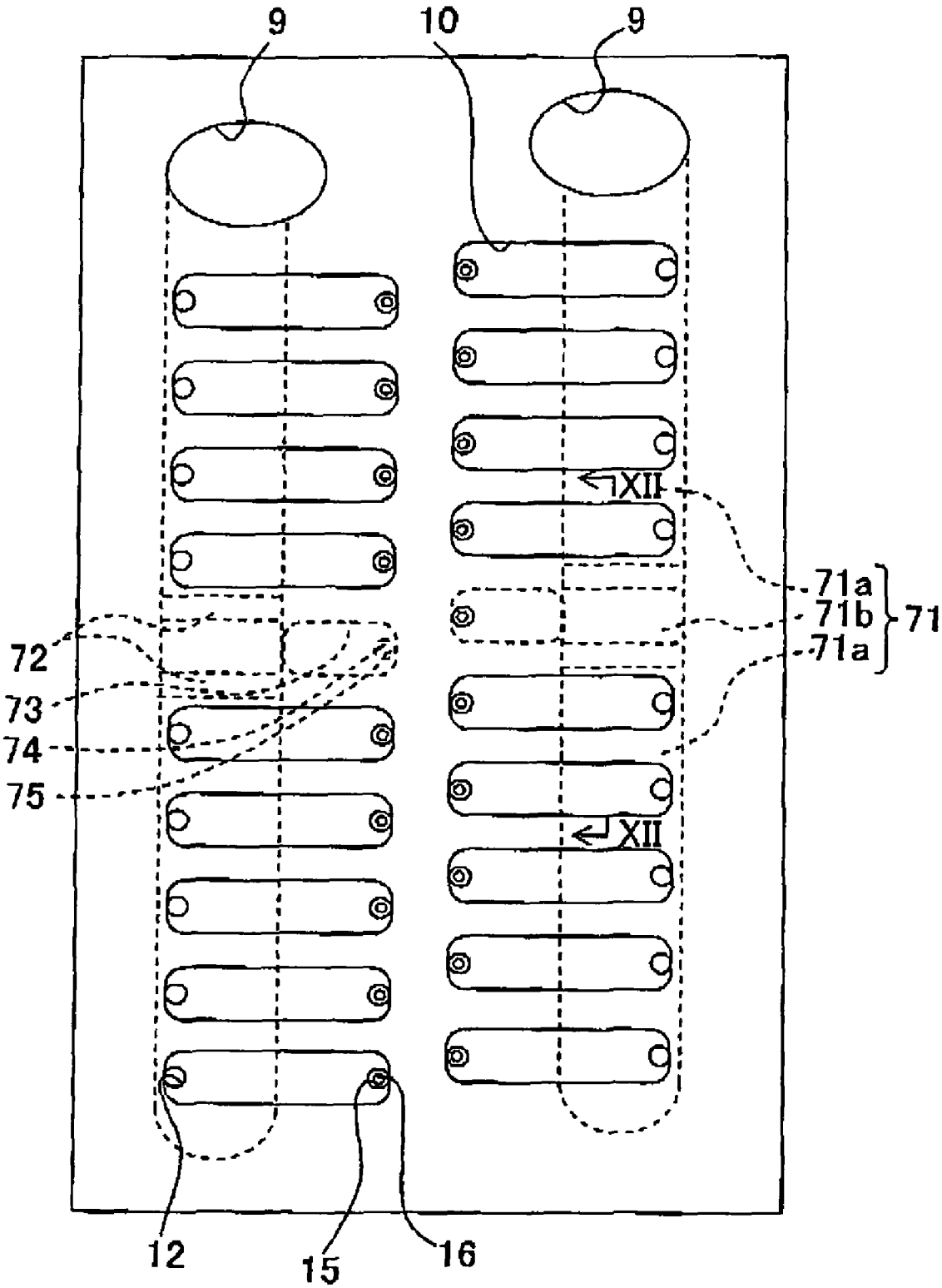
FIG. 11 is a plan view of a fourth modification, corresponding to FIG. 2.
Figure 12:
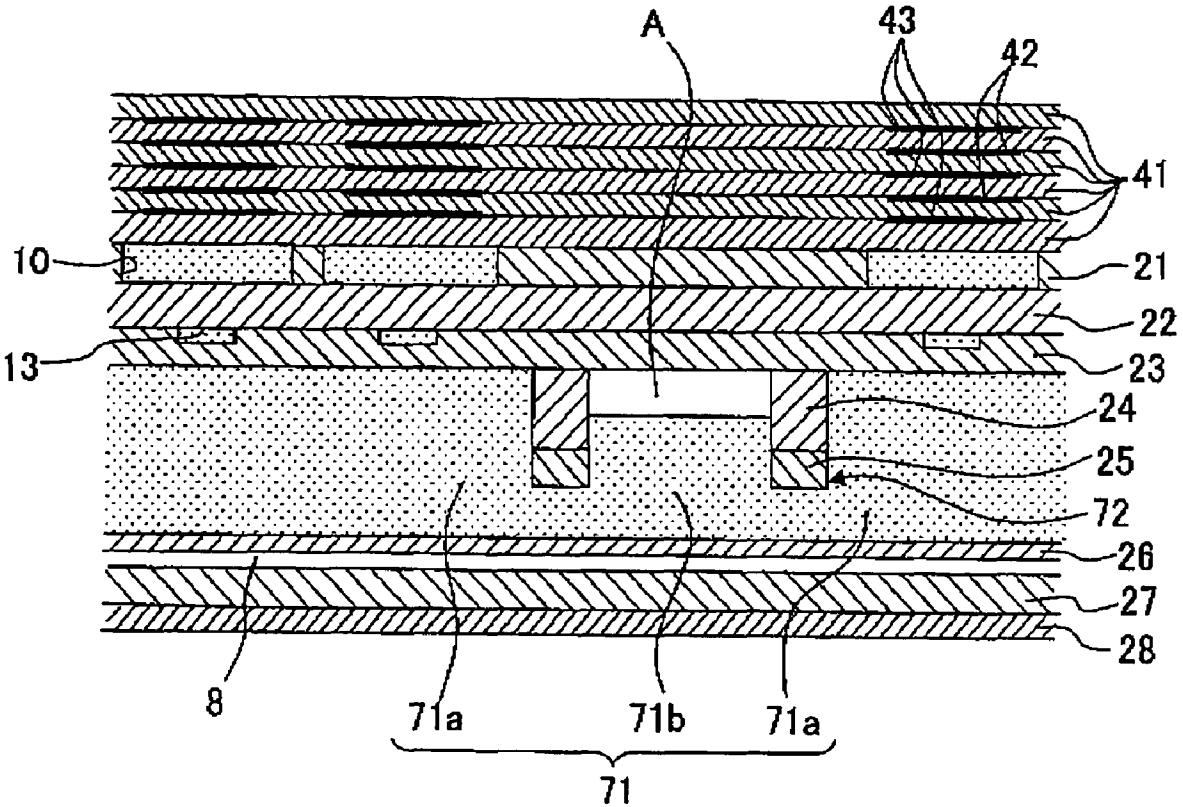
FIG. 12 is a cross-sectional view taken along a line XII-XII in FIG. 11.

In a fourth modification, as shown in FIGS. 11 and 12, a second area 71*b* which communicates with a dummy nozzle 75 via channels 73 and 74 is formed in a manifold channel 71 at an intermediate portion thereof. Further, first areas 71*a* are formed on both sides, in the paper feeding direction (up and down direction in FIG. 11), of the second area 71*b*. In this case, projections 72 are formed each between the second area 71*b* and one of the two first areas 71*a* and between the second area 71*b* and the other of the two first areas 71*a*. A lower half portion of each of the projections 72 is formed by the half etching which makes the upper surface of the manifold plate 25 to be a thin-walled portion. In this case also, it is possible to attenuate the pressure wave in the manifold channel 71 efficiently by the air A in the second area 71*b*. Due to the presence of the second area 71*b*, when there is a difference in a supply capacity of the ink at portions in the upstream and downstream of the manifold channel 71, ink supply ports may be provided at both ends, respectively, of the manifold channel 71.

Further, each of the above-described embodiment and modifications has 18 pieces of the pressure chambers 10, and the manifold channels extended in a substantially linear manner. However, the present invention is not limited to the number of pressure chambers and the shape of the manifold channel. Furthermore, the step-surface 17*b* which partitions the first area and the second area may be formed as a surface forming a plurality of steps, or as an inclined surface which is inclined in the up and down direction.

Figure 13:
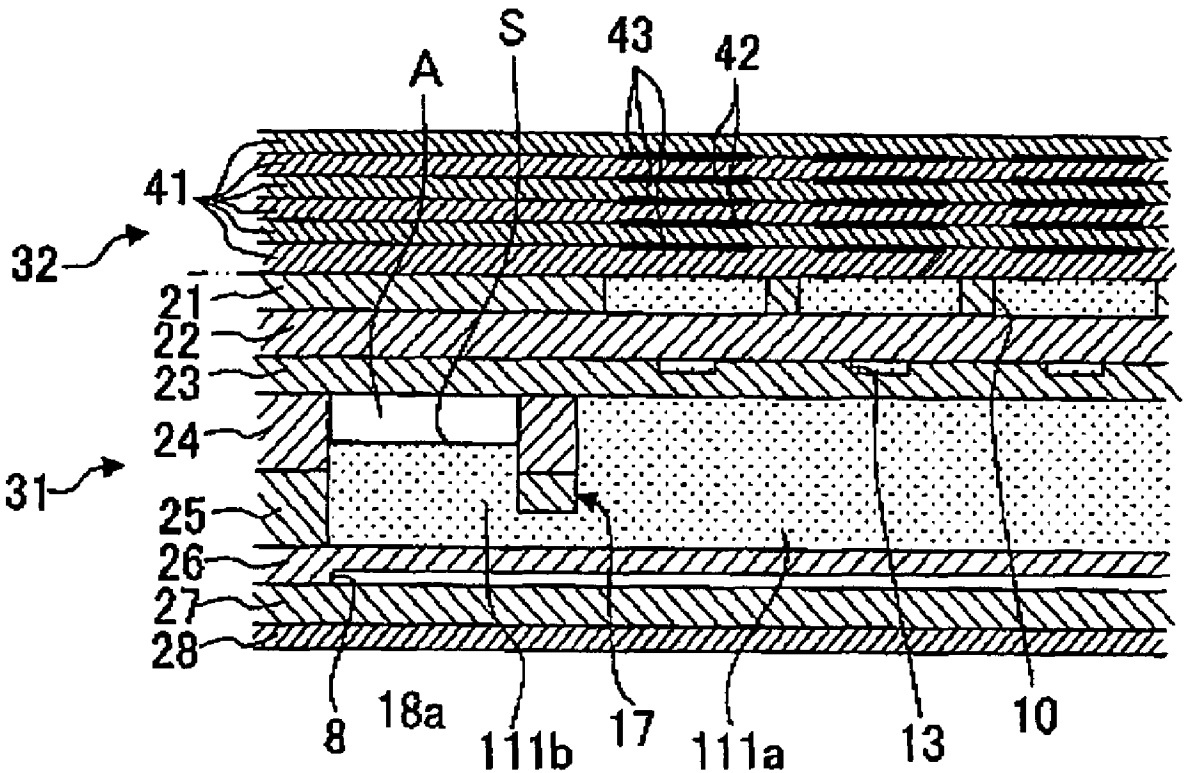
FIG. 13 is a cross-sectional view of another embodiment, corresponding to FIG. 3.

Further, in each of the embodiment and the modifications, the channels 18 and 19, and the connecting port 18*a* from the manifold channel 11 and reaching up to the dummy nozzle 20 are provided. However, it is not indispensably necessary that the connecting port 18*a*, and the channels 18 and 19 are provided. In other words, it is also allowable that the gas (air) is sealed in the manifold channel 11 in a portion thereof corresponding to the second area. For example, as shown in FIG. 13, it is possible to provide an air damper chamber 111*b* which is in fluid communication with a manifold channel 111*a* (common liquid chamber) and maintains (contains) the air A; and to form, in the air damper chamber 111*b*, an interface S at which the ink in the manifold channel 111*a* and the air A in the air damper chamber 111*b* directly makes contact with each other, thereby obtaining an effect similar to that in the embodiment and the modifications. In other words, the interface between the liquid (ink) and the gas (air), which is maintained or contained in the air damper chamber 111*b*, is changed or varied according to the pressure wave and/or the pressure fluctuation (pressure variation) in the manifold channel 11, thereby making it possible to assuredly and instantaneously absorb and eliminate the pressure wave and the pressure fluctuation in the common liquid chamber. Consequently, even when the liquid-droplet jetting apparatus is highly densified and miniaturized, it is possible to attenuate the pressure wave in the manifold channel 11 efficiently. Further, by omitting the dummy nozzle 20, the connecting port 18*a*, and the channels 18 and 19, it is possible to simplify the structure of the channel unit 31 by a dimension of a space which would otherwise be occupied by the omitted parts or components.

Furthermore, the embodiment and the modifications have been explained by an example in which the present invention is applied to an ink-jet head. However, the present invention is also applicable to a liquid-droplet jetting apparatus which jets a liquid other than ink such as a reagent, a biomedical solution, a wiring material solution, electronic material solution, a cooling medium (refrigerant), a fuel, and the like.

What is claimed is:

1. A liquid-droplet jetting apparatus which jets liquid droplets of a liquid, the apparatus comprising a channel unit having a common liquid chamber which extends in a predetermined direction, a first individual liquid channel which is from a first connecting port to the common liquid chamber and up to a first jetting port via a pressure chamber, and a second individual liquid channel which is from a second connecting port to the common liquid chamber up to a second jetting port;

wherein the pressure chamber is formed as a plurality of pressure chambers arranged in a row along the common liquid chamber to form a pressure-chamber surface;

the common liquid chamber includes an upper wall surface which extends in the predetermined direction, a lower wall surface which is separated from the upper wall surface in a direction orthogonal to the pressure-chamber surface and which faces the upper wall surface, and a step-surface which extends from the upper wall surface so as to intersect the pressure-chamber surface;

the step-surface partitions the common liquid chamber into a first area with which the first individual liquid channel communicates, and a second area with which the second individual liquid channel communicates; and with respect to the direction orthogonal to the pressure-chamber surface, a distance between the pressure-chamber surface and a step-surface farthest portion, of the step-surface, which is disposed farthest from the pressure-chamber surface is greater than a distance between the second connecting port and the pressure-chamber surface; and an upper wall surface of the second area is separated from the second connecting port.

2. The liquid-droplet jetting apparatus according to claim 1, wherein with respect to the direction orthogonal to the pressure-chamber surface, the distance between the pressure-chamber surface and the step-surface farthest portion is greater than a distance between the pressure-chamber surface and a farthest portion, of a portion defining the second connecting port, which is disposed farthest from the pressure-chamber surface.

3. The liquid-droplet jetting apparatus according to claim 1, wherein with respect to the direction orthogonal to the pressure-chamber surface, a distance between the pressure-chamber surface and an upper wall surface of the first area, is same as a distance between the pressure-chamber surface and the upper wall surface of the second area.

4. The liquid-droplet jetting apparatus according to claim 1, wherein with respect to the direction orthogonal to the pressure-chamber surface, a distance between the pressure-chamber surface and an upper wall surface of the first area, is greater than a distance between the pressure-chamber surface and the upper wall surface of the second area.

5. The liquid-droplet jetting apparatus according to claim 4, wherein with respect to the direction orthogonal to the pressure-chamber surface, the distance between the pressure-chamber surface and the step-wall farthest portion is same as the distance between the pressure-chamber surface and the upper wall surface of the first area.

6. The liquid-droplet jetting apparatus according to claim 1, wherein in the common liquid chamber, a liquid inflow port into which the liquid inflows and which is connected to the first area, the first area, the step-surface, and the second area are formed in this order along the predetermined direction;

and the second area is connected to the first area via the step-surface.

7. The liquid-droplet jetting apparatus according to claim 6, wherein the common liquid chamber includes a plurality of common liquid sub-chambers formed in the channel unit; and the channel unit further includes a connecting channel which extends to connect at least two common liquid sub-chambers, among the plurality of common liquid sub-chambers, at the second area of each of the at least two common liquid sub-chambers.

8. The liquid-droplet jetting apparatus according to claim 1, wherein a channel resistance in the second individual liquid channel is smaller than a channel resistance in the first individual liquid channel.

9. The liquid-droplet jetting apparatus according to claim 1, wherein the first area and the second area have a same natural frequency.

10. The liquid-droplet jetting apparatus according to claim 1, further comprising an energy imparting mechanism which imparts a jetting energy to the liquid in the pressure chambers;

wherein the energy imparting mechanism includes a piezoelectric layer facing the pressure chambers, and at least one pair of electrodes which applies an electric field to the piezoelectric layer.

* * * * *